United States Patent [19]

Cromer et al.

[11] 4,291,208

[45] Sep. 22, 1981

[54] GAS-INSULATED CIRCUIT-INTERRUPTER HAVING IMPROVED INSULATING NOZZLE

[75] Inventors: Charles F. Cromer, Penn Township, Allegheny County; Kue H. Yoon, Pittsburgh; Robert L. Hess, North Versailles, all of Pa.; Thomas Kelsey, Northumberland, England; Michael G. Caithness, Edinburgh, Scotland

[73] Assignees: Westinghouse Electric Corp., Pittsburgh, Pa.; Northern Engineering Industries Ltd., Newcastle upon Tyne, England

[21] Appl. No.: 963,633

[22] Filed: Nov. 24, 1978

[51] Int. Cl.[3] ..... H01H 33/88

[52] U.S. Cl. ..... 200/148 A; 200/148 C; 200/150 G

[58] Field of Search ..... 200/148 R, 148 A, 148 B, 200/148 C, 148 D, 148 E, 148 F, 148 G, 148 H, 148 J, 148 BV, 150 G

[56] References Cited

U.S. PATENT DOCUMENTS 3,909,572 9/1975 Tsubaki et al. ..... 200/148 A 4,139,753 2/1979 Cromer et al. ..... 200/148 A

*Primary Examiner*—J. V. Truhe

*Assistant Examiner*—Morris Ginsburg

*Attorney, Agent, or Firm*—D. M. Boles

[57] ABSTRACT

A gas-insulated circuit interrupter includes stationary and movable contact assemblies which are cooperable with each other to transmit or interrupt electrical current. Means are provided for moving the movable contact assembly, and for establishing a flow in the circuit interrupter during an opening interruption to estinguish the arc which is drawn between the stationary and movable arcing contacts. A hollow insulating nozzle is utilized for directing gas flow. The interior surface of the nozzle is shaped so as to direct a flow of insulating gas to blast into the arc, and the exterior surface of the nozzle is contoured such as to deflect the flow of insulating gas away from the movable main contacts.

9 Claims, 7 Drawing Figures

CLOSED POSITION

GAS-INSULATED CIRCUIT-INTERRUPTER HAVING IMPROVED INSULATING NOZZLE

CROSS REFERENCE TO RELATED APPLICATIONS

Reference is made to copending application for Letters Patent Ser. No. 953,503, filed Oct. 23, 1978 entitled, "Improved Double-Flow Puffer-Type Compressed-Gas Circuit Interrupter" by C. F. Cromer et al., which application is assigned to the same assignee as the present application.

BACKGROUND OF THE INVENTION

This invention relates generally to high-voltage electrical apparatus, and more particularly, to an improved gas-insulated high-voltage circuit interrupter having an improved insulating nozzle for directing the flow of gas.

High-voltage circuit-interrupters typically include a stationary contact structure and a movable contact structure which is cooperable with the stationary contact structure to transfer or interrupt electrical current therebetween. Because of the high voltages involved, each contact structure typically includes main contacts which transmit the majority of electrical current during normal operations, and arcing contacts for use during the interrupting operation. The arcing contacts are generally made of a high arc-resistant material, so that during the opening operation, where the arcing contacts part last, the arc which is drawn between the arcing contacts will not cause a deterioration of the contacts. Because of the higher voltages involved, and the need to extinguish the resultant arc between the two contact structures, means are typically included within the circuit interrupters to blast a flow of the insulating gas into the arc to cause a scattering of the ion stream occurring thereabout, extinguishing the arc more rapidly and with less damage to the various elements of a circuit interrupter. Typically, a hollow insulating nozzle is utilized for directing this flow of gas into the arc.

Because of more stringent performance specifications issued by purchasers of the equipment, manufacturers of high-voltage gas-insulated circuit interrupters are currently being required to improve the performance of their interrupters. One such improvement which is desirable is to increase the dielectric recovery characteristic of the interrupter; others are to improve the conductivity of the interrupter when in the closed position, and to increase the open circuit voltage withstand of the interrupter.

BRIEF SUMMARY OF THE INVENTION

An improved gas-insulated circuit-interrupter is provided by this invention which includes stationary and movable contact assemblies each including main contact means and arcing contact means, with the stationary and movable contact assemblies being cooperable with each other. Means for moving the movable contact assembly, and for establishing a flow of insulating gas in the circuit interrupter during an opening operation are provided. A hollow insulating nozzle, having an interior and an exterior surface, is included within the circuit interrupter. The interior surface of the nozzle directs the flow of insulating gas to blast into the arc established between the stationary and movable arcing contact means. The nozzle exterior surface is contoured so as to deflect the flow of insulating gas which was blasted into the arc away from the movable main contact means.

BRIEF DESCRIPTION OF THE DRAWINGS

Reference is now made to the Description of the Preferred Embodiment, illustrated in the accompanying drawings, in which.

DESCRIPTION OF THE PREFERRED EMBODIMENT

Figure 1:
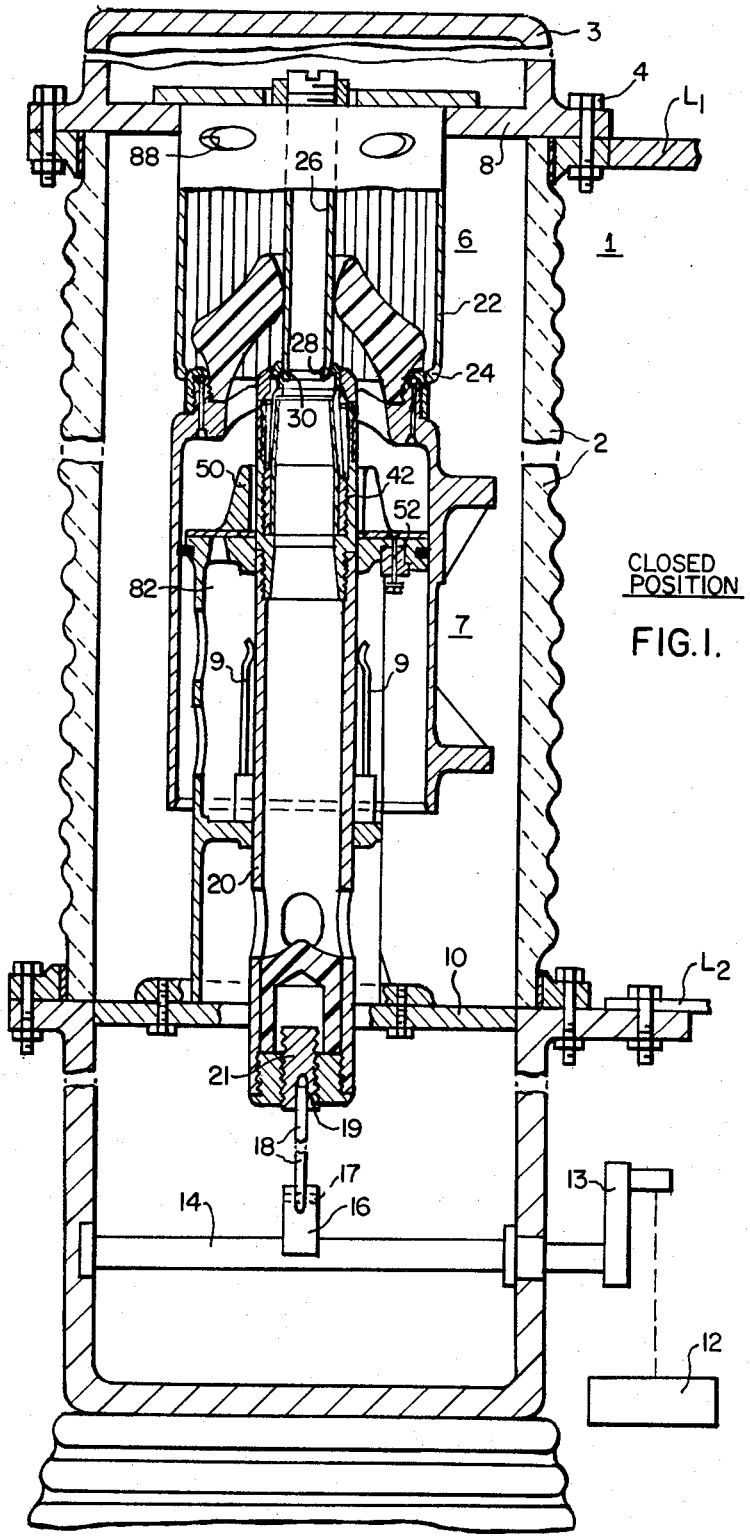
FIG. 1 is a sectional view of a gas-insulated circuit breaker according to the teachings of this invention with the main contacts and the arcing contacts in the closed position.
Figure 2:
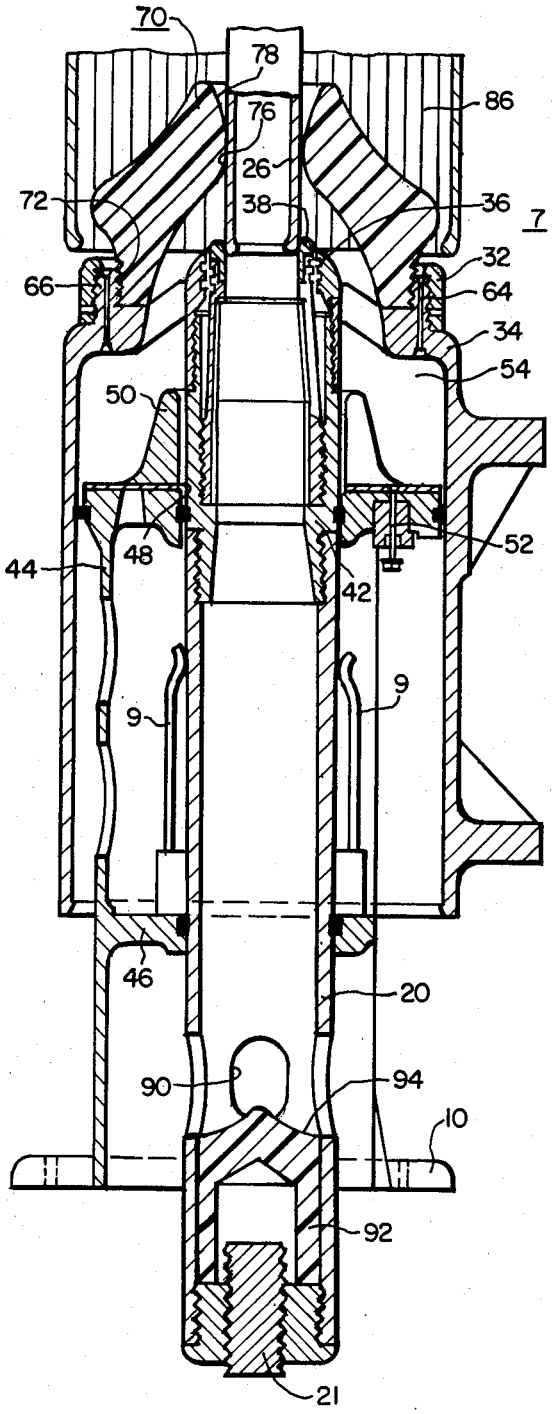
FIG. 2 is a sectional view of the interrupting unit showing the main contacts in the open position and the arcing contacts in the closed position.
Figure 3:
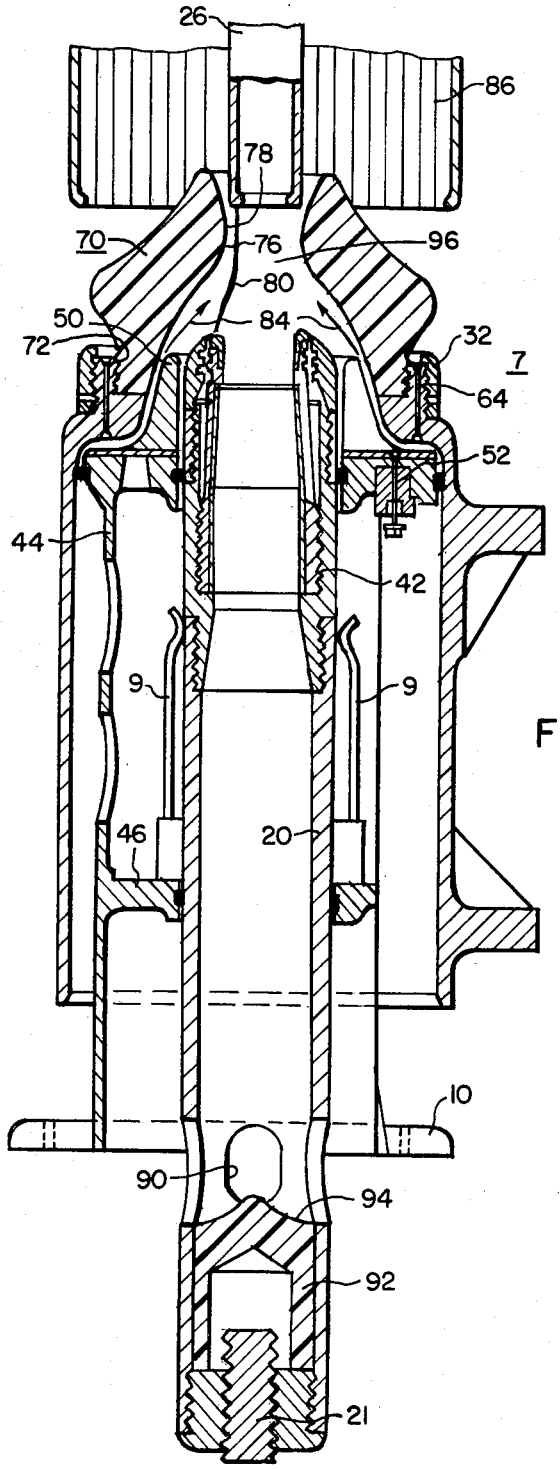
FIG. 3 is a sectional view of the interrupting unit showing the main contacts in the open position and the arcing contacts separated with an arc being drawn therebetween.

Referring to the drawings, and more particularly to FIGS. 1–3 thereof, therein is illustrated a puffer-type compressed-gas-insulated circuit interrupter 1, although the teachings of this invention are equally applicable to two-pressure gas blast circuit interrupters, or any other type of gas-insulated circuit interrupter which utilizes a flow of gas to extinguish an arc. The circuit interrupter 1 is comprised of an upstanding insulating casing structure 2, which is provided at its upper end with a metallic dome-shaped conducting cap portion 3, the latter supporting, by means of the bolt 4, a line-terminal connection $L_1$.

Extending downwardly interiorly of the dome-shaped casing 3 from the support plate 8 is a relatively stationary contact structure, designated by the reference numeral 6, and cooperable in the closed-circuit position with the movable contact structure 7. The movable contact structure 7 is electrically connected, by means of conducting fingers 9 and the inward extension 46, to a generally-horizontally extending conducting support plate 10, which provides a second line terminal $L_2$ externally of the casing 2.

A suitable operating mechanism 12 of conventional form affects rotation of an externally-provided crank-arm 13, the latter affecting opening and closing rotative motions of an internally disposed operating shaft 14. The operating shaft 14, in turn, is fixedly connected to an internally disposed rotative crank-arm 16, which is pivotally connected, as at 17, to a floating link 18, the latter being pivotally connected, as at 19, to the lower end of a linearly-movable contact operating rod connector 21.

Referring now to FIG. 2, therein it can be seen that the stationary contact structure 6 is comprised of an outwardly disposed stationary main contact 22, comprised of a plurality of individual stationary main contact fingers 24. Disposed interiorly of the stationary main contact 22 is the stationary arcing contact 26. The stationary arcing contact 26 has, at its outermost location 28 thereof, an arc-resistant material 30.

The movable contact assembly 7 is comprised of an outwardly disposed movable main contact 32, illustrated as being a contact ring threadedly secured to the operating cylinder 34. Disposed interiorly of the movable main contact 32 is the movable arcing contact 36, which, like the stationary arcing contact 26, has an arc resistant material 38 disposed at the outermost end thereof. The movable arcing contact 36 is, for example, threadedly secured to the operating cylinder 34, and is connected to the main body portion of the operating cylinder 34 by the plurality of spiders 40 (see FIGS. 6 and 7). The arcing contact 36 is, for example, threadedly connected to the adapter 42, which adapter 42 in turn is threadedly connected to the operating rod 20. By being so connected, linear movement of the operating rod 20 causes a corresponding linear movement of the arcing fingers 36, and also causes a linear movement of the movable main contact 32 and the operating cylinder 34 because of the fixed connection of the operating cylinder 34 to the movable arcing contact 36. Thus, movement of the operating rod 20 causes a corresponding movement of the operating cylinder 34, the movable main contact 32, and the movable arcing contact 36.

Fixedly secured to the support plate 10 is the relatively-stationary piston structure 44. The piston structure 44 maintains electrical contact with the movable main and arcing contacts 32 and 36, respectively, through the current carrying fingers 9 which are fixedly secured to an inward extension 46 of the piston structure 44, and which contact fingers 9 remains slidingly in contact with the operating rod 20, which operating rod 20 and the adapter 42 secured thereto are at the same electrical potential as the arcing contact 36, which contact 36 is at the same potential as the movable main contact 32 because of the electrical conductivity of the operating cylinder 34. The stationary piston 44 has an opening 48 centrally disposed therein, through which extends the adapter 42, the operating rod 20, and the arcing contact 36. Disposed about the piston opening 48 are a plurality of finned cooler segments 50, whose function will hereinafter be explained in detail. A check valve 52 extends through the piston 44, and is utilized to allow gas to flow in the space 54 between the piston 44 and the operating cylinder 34 whenever the interrupting unit is moving to the closed position.

Figure 6:
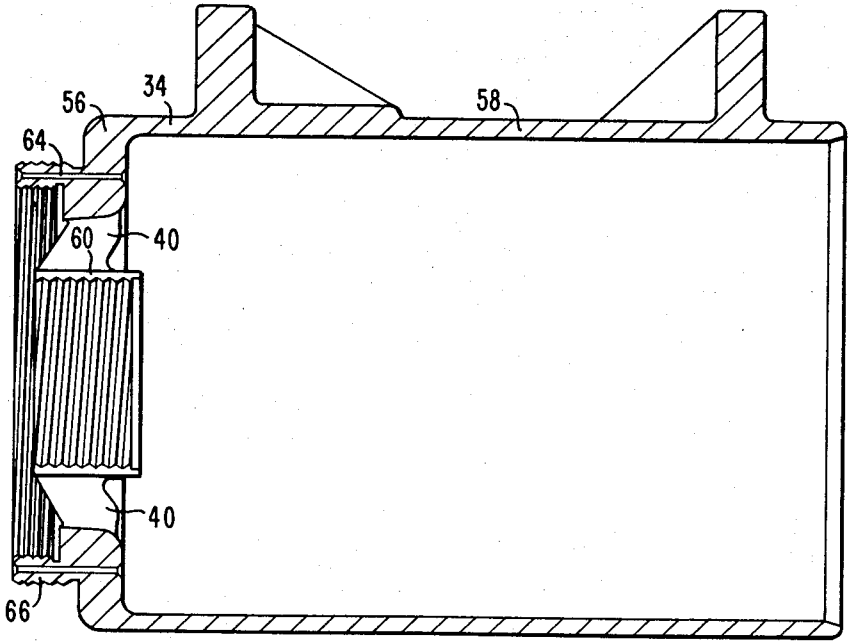
FIG. 6 is a sectional view of the operating cylinder utilized in the interrupting unit.
Figure 7:
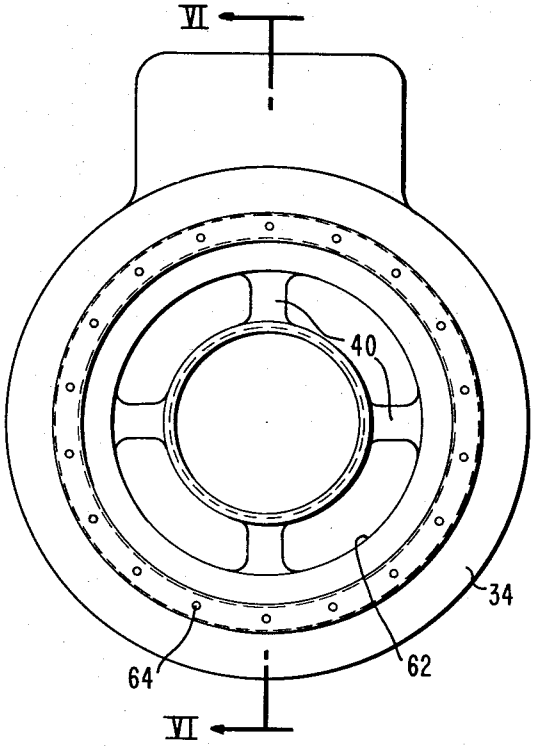
FIG. 7 is a plan view of the operating cylinder illustrated in FIG. 6.

Referring now to FIGS. 2, 6 and 7, it can be seen that the operating cylinder 34, which typically would be of a good electrically-conducting material such as aluminum, is comprised of an end portion 56 and a sidewall portion 58. The end portion 56 and the sidewall portion 58 are dimensioned so as to be nestable over the stationary piston 44. As previously described, a plurality of spiders 40 are utilized to connect the central portion 60 of the operating cylinder 34, to which is secured the movable arcing contact 36, to the remainder of the end portion 56. The spiders 40 are utilized to provide a plurality of kidney-shaped openings 62 through which, when the interrupter 1 is in the fully open position, the cooler segments 50 which are secured to the stationary piston 44, extend. Also to be noted is that a plurality of holes 64 extend through the operating cylinder 34 adjacent to the location 66 where the movable main contact 32 is threadedly secured to the operating cylinder 34. These holes 64 extend through the operating cylinder 34 so that there is communication between the space 54 between the operating cylinder 34 and the piston 44 and to the area adjacent to the movable main contact 32.

Figure 5:
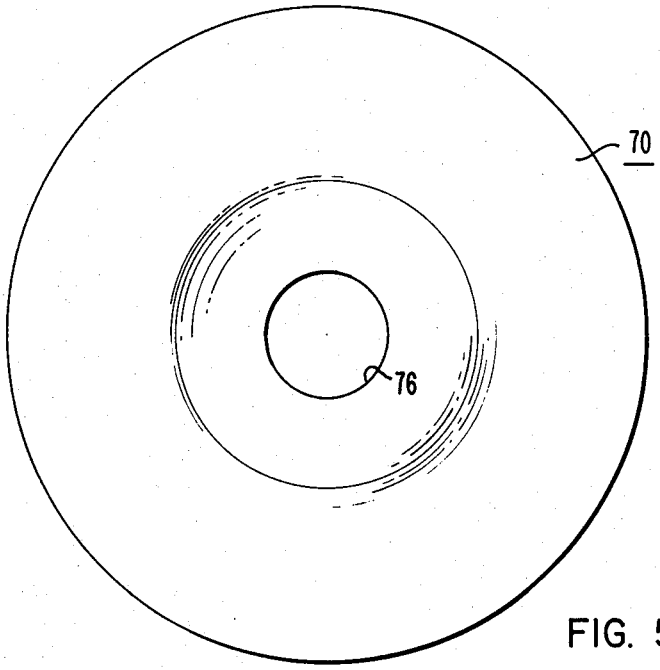
FIG. 5 is a plan view of the insulating nozzle illustrated in FIG. 4.
Figure 4:
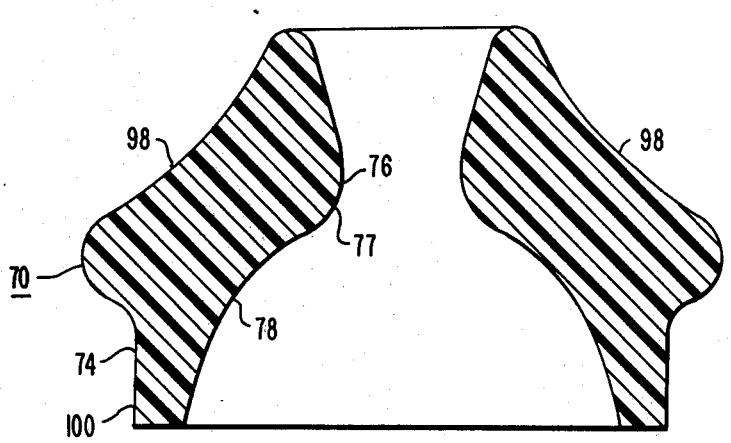
FIG. 4 is a sectional view of the hollow insulating nozzle utilized in the interrupting unit.

Referring now to FIGS. 2, 4 and 5, it will be noticed that a hollow insulating nozzle 70 is threadedly secured to the operating cylinder 34 and functions to direct the flow of insulating gas. Also to be noted is that the nozzle 70 is connected to the operating cylinder 34 at a location 72 which is adjacent to the holes 64 which extend through the operating cylinder 34. By being so disposed, the exterior surface 74 of the nozzle 70 can be utilized to direct the flow of gas which flows through the hole 64 over the movable main contact 32.

The insulating nozzle 70 is hollow, having an opening 76 therethrough between the interior surfaces 78 thereof. The opening 76, at its narrowest point 77, just permits passage of the stationary arcing contact 26, and the entire interior surface 78 of the nozzle 70 is shaped so as to direct the flow of insulating gas into the arc 80 (see FIG. 3) to aid extinction thereof.

Referring now sequentially to FIGS. 1, 2 and 3, the opening operation of the interrupter 1 is as follows. In FIG. 1, the movable contact structure 7 is in the closed position with respect to the stationary contact structure 6. As the operating rod connector 21 and operating rod 20 move downward, they cause a corresponding downward movement of the adapter 42, and the movable arcing contact 36 secured thereto. This causes a corresponding downward movement of the operating cylinder 34 to which the movable arcing contact 36 is secured, thereby also causing a downward movement of the movable main contact 32. The downward movement of the operating cylinder 34 compresses the gas 82, typical of which is sulphur hexafluoride, which is disposed within the space 54 between the operating cylinder 34 and the stationary piston 44. As shown in FIG. 2, the movable main contact 32 separates from the stationary main contact 22 prior to the separation of the movable arcing contact 36 from the stationary arcing contact 26.

Further downward movement of the operating rod 20 causes a separation between the stationary arcing contact 26 and the movable arcing contact 36, with an arc 80 being drawn therebetween. The operating cylinder 34 has moved further past the piston 44, and the gas 82 in the space 54 has compressed and is flowing, as designated by the arrows 84, through the nozzle 70. The nozzle 70, and more particularly, the interior surface 78 thereof, is directing this flow 84 of gas into the arc 80 to provide extinguishment thereof.

It is to be noted that the blast of gas, once past the arc 80, flows in a plurality of directions. One flow of gas is into the area 86 between the stationary main and arcing contacts 22, 26, where it can exhaust out of ports 88. A second flow of gas is through the hollow, tubular movable arcing contact 36, through which it also flows through the hollow, tubular operating rod 20 so that it may exhaust out of the opening 90 provided in the operating rod 20 distal from the piston 44 and the operating cylinder 34. Adjacent to the opening 90 in the operating rod 20 is a flow guide 92 which has an upper surface 94 thereof contoured so as to facilitate the change of direction of the gas exhausting through the operating rod opening 90. By utilizing the flow guide 92, the interrupting unit achieves a higher orifice factor.

In addition to the two described flows of gas, the gases which have blasted through the arc 80 can also move radially outwardly from the area 96 between the stationary and movable arcing contacts 26, 36, respectively. If these hot gases blow back or are reflected back toward the moving contact assembly 7, and more specifically into the region of the movable main contact 32, the combination of a low dielectric strength and high gradient at the surface of the movable main contact 32 can result in a dielectric failure and an arcing flashover between the movable main contact 32 and the stationary contact assembly 6. In order to reduce this effect, the nozzle exterior surface 74, particularly at the region 98, is contoured to deflect the flow of compressed gas which flowed into the arc 80 away from the movable main contact 32. As a further deterent to flashover, cool gas flows through the openings 64 in the operating cylinder 34 from the space 54 to adjacent the movable main contacts 32. This second flow of gas is expelled against the lower exterior surface 100 of the nozzle 70, which is likewise contoured to direct this second flow of gas both over the movable main contact 32, and additionally, the contour of the lower exterior surface 100 provides that the flow of gas from the openings 64 is in communication with the flow of gas which is deflected by the region 98 away from the movable main contacts 32 so as to provide mixing of these two flows of gas. This mixing of the two flows of gas provides for a cooling of the gases which are near the movable main contact 32. To assure that the gas which flows through the openings 64 is cooled, and does not contain any hot gases which may be expanding backward from the region 96, the cooling fins 50 are provided adjacent to the nozzle 70 and the openings 64, so that any backward expansion of gas is cooled by the cooling fins 50 prior to entering the holes 64.

As a further improvement, the movable main contact 32 can be made of a more arc resistant material than the operating cylinder 34. When the circuit interrupter 1 changes from the closed position to the open position under fault conditions, the current must be transferred from the main current circuit between the stationary and movable main contacts 22, 32 to the central circuit between the stationary arcing contact 26 and the movable arcing contact 36. This commutation results in arcing, and a material such as aluminum will melt, resulting in not only a high contact drop on reclosing, but also sharp points with high gradients conducive to flashover. Therefore, the movable main contact 32 can be made of a more arc resistive material, such as copper or a copper-containing alloy, than the electrically-conducting material of which the operating cylinder is made, which typically is aluminum.

Thus, it can be seen that an improved gas-insulated circuit interrupter has been described which results in an improvement in the dielectric recovery characteristic of the interrupter, improves the conductivity in the closed position, and increases the open circuit voltage withstand capability of the interrupting unit.

We claim as our invention:

1. A gas-insulated circuit interrupter comprising:

a stationary contact assembly including stationary main contact means and stationary arcing contact means;

a movable contact assembly including movable main contact means and movable arcing contact means, said movable main contact means being cooperable with said stationary main contact means and said stationary arcing contact means being cooperable with said movable arcing contact means;

means for moving said movable contact assembly;

means for establishing a first flow of insulating gas in said circuit interrupter during an opening operation;

a hollow insulating nozzle having an interior surface and an exterior surface, said nozzle interior surface directing said first flow of insulating gas to blast into the arc established between said stationary and movable arcing contact means, said nozzle exterior surface being contoured to deflect said first flow of insulating gas away from said movable main contact means; and means establishing a second flow of insulating gas past said movable main contact means.

2. The circuit interrupter according to claim 1 wherein said nozzle exterior surface is contoured to direct said second flow of insulating gas into communication with said first flow of insulating gas such as to provide mixing of said first and second flow of insulating gas.

3. The circuit interrupter according to claim 1 including means for cooling said second flow of insulating gas.

4. A gas-insulated circuit interrupter comprising:

means defining a stationary contact structure including stationary main and arcing contacts;

a piston;

an operating cylinder movable with respect to said piston to compress gas therebetween;

a movable contact structure cooperable with said stationary contact structure and carried by said operating cylinder, said movable contact structure including a movable main contact and a movable arcing contact spaced from said movable main contact; and a hollow insulating nozzle carried by said operating cylinder and disposed intermediate said movable main contact and said movable arcing contact, said nozzle having an interior surface and an exterior surface, said nozzle interior surface directing an inward flow of compressed gas compressed between said piston and said operating cylinder into the arc established between said stationary and movable arcing contacts during an opening operation, said nozzle exterior surface being contoured to deflect the flow of compressed gas which flowed into the arc away from said movable main contact;

said operating cylinder having an opening therein disposed intermediate said nozzle and said movable main contact, said operating cylinder opening communicating with said gas compressed between said operating cylinder and said piston, said nozzle exterior surface being contoured to direct the flow of gas from said operating cylinder opening past said movable main contact.

5. The circuit interrupter according to claim 4 including a plurality of finned cooler segments fixed on said piston adjacent said operating cylinder opening.

6. The circuit interrupter according to claim 4 wherein said movable arcing contact is tubular, and including a tubular operating rod secured to said movable arcing contact, said operating rod having an opening therein distal from said operating cylinder and said piston, whereby arced gas from the arcing region can flow through said movable arcing contact and said operating rod and exhaust out through said operating rod opening.

7. The circuit interrupter according to claim 6 including a flow guide disposed adjacent said operating rod opening and contoured so as to facilitate the change of direction of flow of the gas exhausting through said operating rod opening.

8. The circuit interrupter according to claim 4 wherein said operating cylinder is of a first electrically-conducting material, and said movable main contact is of a second electrically-conducting material being more resistant to arcing than said first electrically conducting material.

9. The circuit interrupter according to claim 8 wherein said first electrically-conducting material is aluminum and said second electrically-conducting material is of a copper-containing alloy.

* * * * *